US006322270B1

(12) United States Patent
Togashi

(10) Patent No.: US 6,322,270 B1
(45) Date of Patent: Nov. 27, 2001

(54) TIP ASSEMBLY OF BALL POINT PEN

(75) Inventor: Yasuyuki Togashi, Tokyo (JP)

(73) Assignee: Tokyo Sign Pen Mfg. Co., Ltd., Tokyo (JP)

( * ) Notice: Subject to any disclaimer, the term of this patent is extended or adjusted under 35 U.S.C. 154(b) by 0 days.

(21) Appl. No.: 09/715,451

(22) Filed: Nov. 17, 2000

(30) Foreign Application Priority Data

Feb. 17, 2000 (JP) ..... 12-040008

(51) Int. Cl.[7] ..... B43K 7/10
(52) U.S. Cl. ..... 401/214
(58) Field of Search ..... 401/209, 214, 401/216

(56) References Cited

U.S. PATENT DOCUMENTS 5,056,949 * 10/1991 Petrillo ..... 401/214
5,277,510 * 1/1994 Okamoto et al. ..... 401/214
5,906,447 * 5/1999 Horikoshi ..... 401/214
5,988,922 * 11/1999 Bussiere ..... 401/214
6,042,290 * 3/2000 Ishikawa et al. ..... 401/214
6,193,429 * 2/2001 Kim ..... 401/214

* cited by examiner

*Primary Examiner*—David J. Walczak
*Assistant Examiner*—Peter deVore
(74) *Attorney, Agent, or Firm*—Schmeiser, Olsen & Watts

(57) ABSTRACT

A linear spring (12) for urging a writing ball (2) of a ball point pen forward in a longitudinal direction of the pen without fail is simple in construction, and is therefore produced at a low cost. The pen comprising: a ball housing (1) a front end portion of which is caulked to rotatably hold the wiring ball (2) therein; a holder (5) having a front and a rear end portion thereof inserted into the ball housing (1) and an ink reservoir pipe (15), respectively. The rear end portion of the holder (5) is reduced in diameter, and extends rearward to form an ink inlet portion (9) which is provided with an ink inlet opening (10). A rear end opening of this ink inlet portion (9) is closed with a spring support (11). The linear spring (12) is movably received in the holder (5), and has a length slightly longer than a distance between the writing ball (2) and an inner axial end surface of the spring support (11).

5 Claims, 3 Drawing Sheets

TIP ASSEMBLY OF BALL POINT PEN

BACKGROUND OF THE INVENTION

1. Field of the Invention

The present invention relates to a tip assembly of a ball point pen, and more particularly to a tip assembly of a ball point pen, wherein the tip assembly comprises a writing ball, a ball housing a front end portion of which rotatably holds the writing ball therein, and a holder on a front end portion of which the ball housing is fixedly mounted.

2. Description of the Related Art

In writing operations, a writing ball rotatably mounted in a front end portion of a ball point pen is brought into contact with a recording medium such as a sheet of paper and the like (herein after referred to simply as the paper) which gives a frictional resistance to the writing ball to cause the ball to rotate. Such rotating ball draws the ink out of an ink reservoir of the ball point pen to apply the thus drawn ink to the paper. In a conventional ball point pen, as shown in FIGS. 3 and 4, the writing ball 21 is formed from a thin wire member, and rotatably held in a bore drilled in a front end portion of the ball housing 22 by caulking a peripheral portion of the bore. Prior to performing such caulking operation of the bore in the front end portion of the ball housing 22, an ink channel member 4 provided with a plurality of radial grooves 3 for forming ink flow passages is mounted in the bore. Consequently, after completion of the caulking operation, the writing ball 21 is seated on a seat surface of the ink channel member 4.

Until recently, in most cases, the ink used in the ball point pen has been of oil-based solution type. However, in these day, ink of aqueous solution type tends to be increasingly used in the ball point pen. The aqueous solution type ink comprises: aqueous liquid type ink; and, aqueous gel type ink. The latter, i.e., aqueous gel type ink is larger in viscosity than the aqueous liquid type ink, and capable of keeping its viscosity at relatively high level when stored. However, in writing operations, the aqueous gel type ink has its viscosity decreased since the aqueous gel type ink has a so-called "thixotropy properties". Due to the presence of such thixotropy properties, even when the aqueous gel type ink is used in the ball point pen, there is a fear that the ink leaks from the tip portion of the ball point pen to damage a user's clothes and documents, particularly pockets of the user's clothes. In order to solve the above problem, the conventional ball point pen is provided with a mechanism (shown in FIG. 4) for prevent the ink from leaking the tip portion of the ball point pen. In this conventional mechanism shown in FIG. 4, a compression coil spring 24 is inserted between the writing ball 21 and an inner axial front surface of the holder 23 so as to extend over substantially the entire length of the ball housing 22, and thereby resiliently urging the writing ball 21 forward.

However, in this conventional mechanism, as shown in FIG. 4, the coil spring 24 is constructed of three portions, i.e.,: a rear seating portion 24*a*; an intermediate portion 24*b* which is smaller in outer diameter than the rear seating portion 24*a*; and, a front linear portion 24*c* which is further smaller in outer diameter than the intermediate portion 24*b*. Since the coil spring 24 is very small in size and should be precisely formed in production, it is hard to produce such tiny and complicated coil spring 24. Consequently, the coil spring 24 causes the manufacturing cost of the ball point pen to increase. Furthermore, the front linear portion 24*c* of the coil spring 24 is very thin in diameter, and therefore often trapped in one of the radial grooves 3 of the ink channel member 4; which makes it impossible for the coil spring to properly urge the writing ball 21 forward.

SUMMARY OF THE INVENTION

In view of the above problem inherent in the conventional ball point pen, the present invention was made. Consequently, it is an object of the present invention to provide a tip assembly of a ball point pen, wherein the tip assembly is simple in construction, capable of operating without fail, and produced at a relatively low cost.

In accordance with the present invention, the above object of the present invention is accomplished by providing:

A tip assembly of a ball point pen, comprising:

a ball housing (1) a front end portion of which is caulked to rotatably hold a writing ball (2) therein;

a holder (5) having its front portion and its rear end portion inserted into the ball housing (1) and an ink reservoir pipe (15), respectively, wherein the rear end portion of the holder (5) is reduced in diameter and extends rearward to form an ink inlet portion (9) provided with an ink inlet opening (10), wherein a rear end opening of the ink inlet portion (9) is closed with a spring support (11); and an linear spring (12) movably received in the holder (5), wherein the linear spring (12) has a length slightly longer than a distance between the writing ball (2) and an inner axial end surface of the spring support (11).

In the tip assembly of the ball point pen having the above construction, preferably, the linear spring (12) is constructed of a resilient filament having a diameter of from approximately 0.1 to approximately 0.25 mm.

Further, preferably, the resilient filament of the linear spring (12) is made of a stainless steel.

Still further, preferably, the resilient filament of the linear spring (12) is made of a synthetic resin.

Further, preferably, the spring support (11) has the inner axial end surface thereof formed into a V-shaped concave form in longitudinal section of the spring support (11).

The ink jet recording head having the above construction has the following effect: namely, since the means for urging the writing ball 2 is constructed of the linear spring 12, it is possible to produce such linear spring 12 at a low cost. In addition, since it is also possible to increase the linear spring 12 in its filament diameter, there is no fear that a front end portion of the linear spring 12 constantly urging the writing ball 2 forward is trapped in the radial grooves 3 of the ink channel member 4, which ensures that the writing ball 2 of the ball point pen of the present invention is capable of performing proper writing operations without fail.

BRIEF DESCRIPTION OF THE DRAWINGS

The above and other object, advantages and features of the present invention will be more apparent from the following description taken in conjunction with the accompanying drawings in which.

DETAILED DESCRIPTION OF THE PREFERRED EMBODIMENTS

The best modes for carrying out the present invention will be described in detail using embodiments of the present invention with reference to the accompanying drawings.

Figure 1:
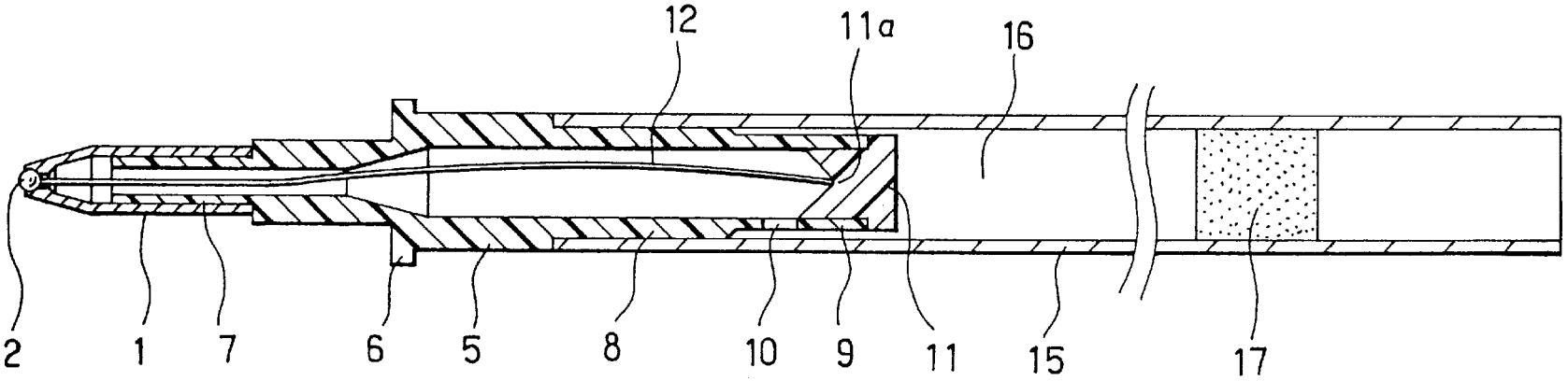
FIG. 1 is a longitudinal sectional view of the tip assembly of the ball point pen of the present invention.

FIG. 1 is a longitudinal sectional view of a tip assembly of a ball point pen of the present invention, in which the tip assembly is fixedly mounted on an ink reservoir pipe 15.

Figure 3:
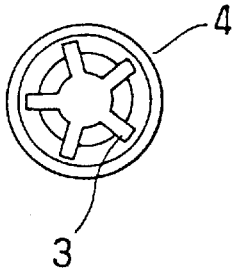
FIG. 3 (PRIOR ART)
FIG. 3 is a front view of the ink channel member of the tip assembly shown in each of FIGS. 1 and 4.

As shown in FIG. 1, the tip assembly of the ball point pen of the present invention is constructed of: a writing ball 2; an ink channel member 4 (shown in FIG. 3); a ball housing 1; a linear spring 12; a holder 5; and, a spring support 11.

Figure 4:
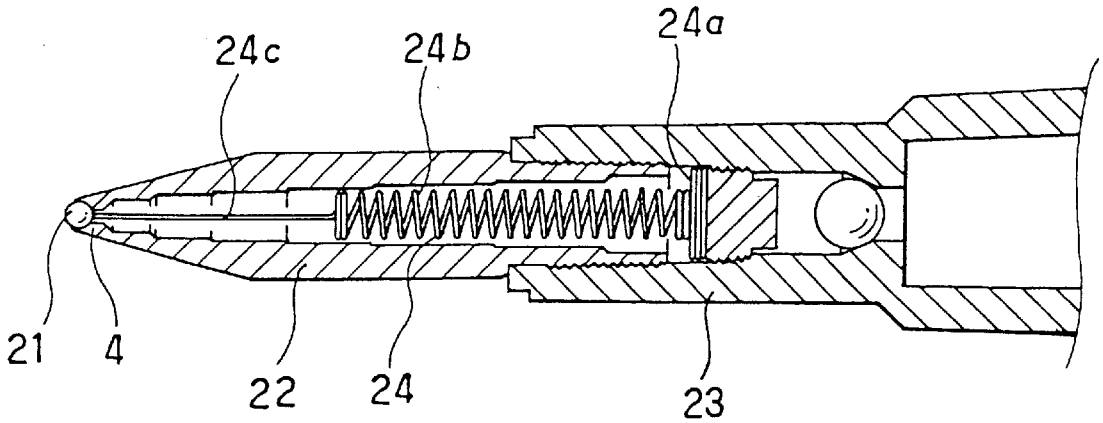
FIG. 4 (PRIOR ART)
FIG. 4 is a longitudinal sectional view of the conventional ball point pen, illustrating the conventional tip assembly used therein.

As is clear from FIGS. 1 and 4, there is substantially no difference between the ball housing 1 of the ball point pen of the present invention and a conventional ball housing 22 of the conventional ball point pen. More particularly, the ball housing 1 is constructed of a rod member provided with a through-hole drilled therein, wherein the rod member has its outer peripheral surface subjected to machining operations, and its front end portion caulked to rotatably hold the writing ball 2 therein. Prior to performing such caulking operation, the ink channel member 4 is mounted in a front bore portion of the through-hole of the ball housing 1. This ink channel member 4 is provided with a plurality of radial grooves 3 for forming ink flow passages, as is in the case of the conventional ink channel member 4 shown in FIG. 3. In writing operations, the writing ball 2 is retracted inward against a resilient force exerted by the linear spring 12, and seats on the ink channel member 4 when the writing ball 2 is brought into contact with the recording medium or paper.

The holder 5 is provided with an inner flange portion (not shown) in its intermediate portion for fixing a refill (not shown) inserted in the holder 5. Further, the holder 5 has: its front and its rear end portion formed into a front end insertion portion 7 and a rear end insertion portion 8, respectively, wherein the front end insertion portion 7 is inserted into a rear end opening of the ball housing 1, while the rear end insertion portion 8 is inserted into a front end opening of the ink reservoir pipe 15. The rear end insertion portion 8 of the holder 5 has its rear end portion reduced in outer diameter to form an ink inlet portion 9. This ink inlet portion 9 is provided with an ink inlet opening 10 in its wall portion, as shown in FIG. 1. Further, the ink inlet portion 9 of the holder 5 has its rear end opening closed with a tail plug called "spring support 11" inserted therein. Consequently, ink contained in the ink reservoir pipe 15 is supplied to the writing ball 2 or a front end portion of the tip assembly of the present invention through an annular clearance between the ink reservoir pipe 15 and the ink inlet portion 9, the ink inlet opening 10, and then through the holder 5. Incidentally, as shown in FIG. 1, the ink reservoir pipe 15 is provided with a grease member 17 in its rear end portion. The grease member 17 functions to permit the ink contained in the ink reservoir pipe 15 to flow forward only.

Figure 2A:
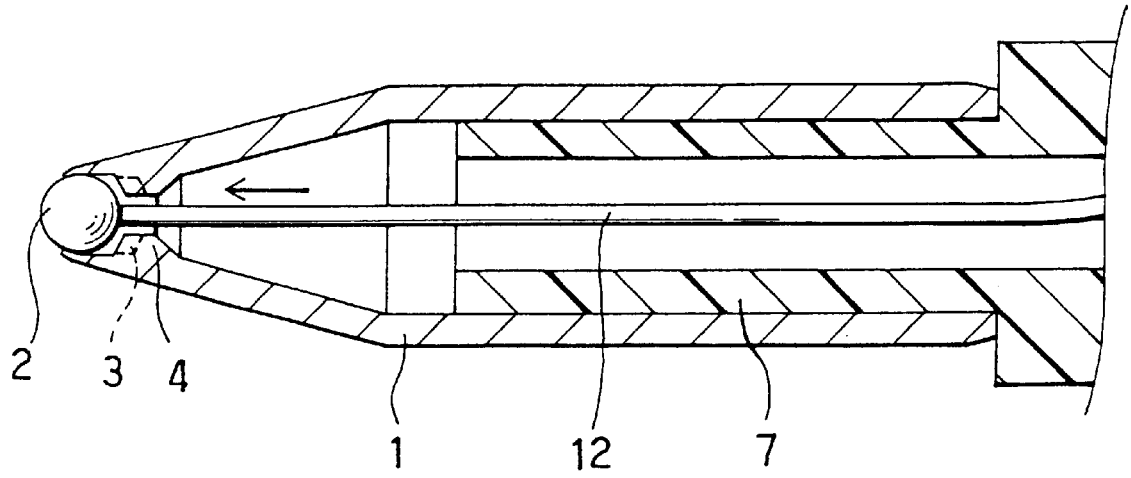
FIGS. 2A and 2B are enlarged longitudinal sectional views of the tip assembly, illustrating the behavior of the writing ball 2 shown in FIG. 1.
Figure 2B:
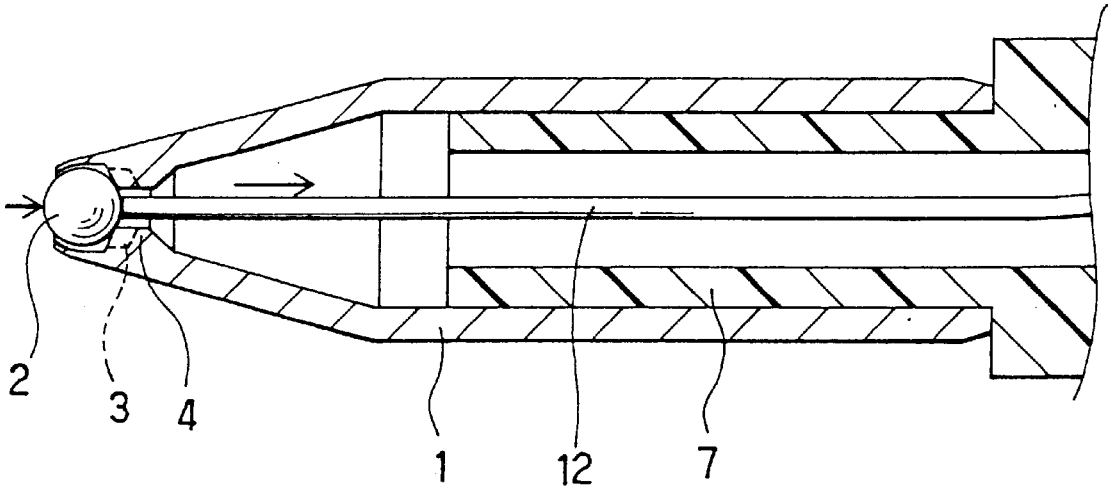

In assembly operations, firstly, the linear spring 12 is inserted into the holder 5. The linear spring 12 is constructed of a filament member. This filament member is made of stainless steels or of resin materials, and has a diameter of from 0.1 to 0.25 mm. In this embodiment, the diameter of the filament member is 0.2 mm. The entire length of the linear spring 12 is slightly longer than a distance between an inner axial end surface of the spring support 11 and the writing ball 2. Consequently, as viewed in FIG. 1, the linear spring 12 after its installation in the holder 5 is slightly curved. As a result, the writing ball 2 is always subjected to a forward force exerted by the linear spring 12, as shown in FIG. 2A. Unless the writing ball 2 is subjected to a strong rearward force such as those produced during the writing operations, the writing ball 2 remains in its closing position in which the writing ball 2 closes the ink flow passage formed around the writing ball 2 since the writing ball 2 is always under the influence of the resilient force exerted by the linear spring 12, and thereby preventing the ink from leaking out of the tip assembly of the ball point pen of the present invention.

In order to prevent the linear spring 12 from deviating from its normal position, the spring support 11 has its inner axial end surface formed into a V-shaped concave form in longitudinal section of the spring support 11, thereby ensuring that the linear spring 12 has its rear end portion located at a bottom center 11*a* of the inner axial end surface of the spring support 11, as shown in FIG. 1.

Incidentally, the linear spring 12 has its front end portion passed through a central opening of the ink channel member 4. Consequently, the linear spring 12 is capable of properly urging the writing ball 2 forward without fail in contrast with the conventional coil spring 24 shown in FIG. 4.

Finally, the present application claims the Convention Priority based on Japanese Patent Application No. 2000-040008 filed on Feb. 17, 2000, which is herein incorporated by reference.

What is claimed is:

1. A tip assembly of a ball point pen, comprising:

a ball housing (1) a front end portion of which is caulked to rotatably hold a writing ball (2) therein;

a holder (5) having its front portion and its rear end portion inserted into said ball housing (1) and an ink reservoir pipe (15), respectively, wherein said rear end portion of said holder (5) is reduced in diameter and extends rearward to form an ink inlet portion (9) provided with an ink inlet opening (10), wherein a rear end opening of said ink inlet portion (9) is closed with a spring support (11); and an linear spring (12) movably received in said holder (5), wherein said linear spring (12) has a length slightly longer than a distance between said writing ball (2) and an inner axial end surface of said spring support (11).

2. The tip assembly of the ball point pen, as set forth in claim 1, wherein said linear spring (12) is constructed of a resilient filament having a diameter of from approximately 0.1 to approximately 0.25 mm.

3. The tip assembly of the ball point pen, as set forth in claim 2, wherein said resilient filament of said linear spring (12) is made of a stainless steel.

4. The tip assembly of the ball point pen, as set forth in claim 2, wherein said resilient filament of said linear spring (12) is made of a synthetic resin.

5. The tip assembly of the ball point pen, as set forth in claim 1, wherein said spring support (11) has said inner axial end surface thereof formed into a V-shaped concave form in longitudinal section of said spring support (11).

* * * * *